US008889993B1

(12) United States Patent
Misevich

(10) Patent No.: US 8,889,993 B1
(45) Date of Patent: Nov. 18, 2014

(54) SPOOL INSULATOR SYSTEM

(76) Inventor: Gregory E. Misevich, Smithtown, NY (US)

( * ) Notice: Subject to any disclaimer, the term of this patent is extended or adjusted under 35 U.S.C. 154(b) by 0 days.

(21) Appl. No.: 13/534,334

(22) Filed: Jun. 27, 2012

(51) Int. Cl.
*H01B 17/02* (2006.01)

(52) U.S. Cl.
USPC ..... 174/135; 174/158 R; 174/168; 174/178

(58) Field of Classification Search
CPC ..... H01B 17/02; H01B 17/06; H01B 17/20; H01B 17/22; H01B 17/24
USPC ..... 174/135, 137 R, 168, 169, 176, 177, 174/178, 179, 180, 181, 209, 210, 158 R, 174/163 F, 172, 173, 174, 194, 195
See application file for complete search history.

(56) References Cited

U.S. PATENT DOCUMENTS

| | | | | | |
|---|---|---|---|---|---|
| 787,442 | A | | 4/1905 | Flynt et al. | |
| 1,177,867 | A | | 4/1916 | Johnson | |
| 1,802,965 | A | * | 4/1931 | Brady | 248/67.7 |
| 2,454,677 | A | * | 11/1948 | Smalley | 174/149 R |
| 2,625,580 | A | * | 1/1953 | Price | 174/81 |
| 2,650,263 | A | * | 8/1953 | Steinmayer | 174/161 R |
| 2,740,827 | A | * | 4/1956 | Smalley | 174/162 |
| 2,810,012 | A | * | 10/1957 | Sugarman | 174/161 R |
| 2,909,590 | A | * | 10/1959 | Stanley | 174/162 |
| 2,942,821 | A | * | 6/1960 | Bertling | 248/67.7 |
| 3,878,320 | A | * | 4/1975 | Mixon et al. | 174/135 |
| 4,259,545 | A | | 3/1981 | Hayden | |
| 5,413,443 | A | | 5/1995 | Aghamehdi | |
| D375,079 | S | | 10/1996 | Pazdirek | |
| 5,945,636 | A | * | 8/1999 | Sakich et al. | 174/174 |
| 5,981,878 | A | * | 11/1999 | Zhao et al. | 174/158 R |
| 6,291,774 | B1 | | 9/2001 | Williams | |
| 6,303,870 | B1 | * | 10/2001 | Nazaryan et al. | 174/172 |
| 6,881,901 | B2 | * | 4/2005 | Egan | 174/665 |
| D545,271 | S | * | 6/2007 | Robertson | D13/129 |
| 7,432,449 | B2 | | 10/2008 | Kim | |

OTHER PUBLICATIONS

Hubbell, Dec. 27, 2010, http://www.hubbellpowersystems.com/pole-line/service/insulators/.*

* cited by examiner

*Primary Examiner* — Hoa C Nguyen
*Assistant Examiner* — Amol Patel

(57) ABSTRACT

A two-piece spool insulator system for convenient installation of a spool insulator for a power line has a spool insulator first side component and a spool insulator second side component. The spool first side surface has a first side locking pin and a first side locking hole disposed thereon. The spool second side surface has a second side locking pin and a second side locking hole disposed thereon. The spool insulator has a channel disposed through a central cross-section. For use, the spool insulator first side component attaches to the spool insulator second side component to form a spool insulator system for convenient installation of a spool insulator for a power line.

3 Claims, 4 Drawing Sheets

SPOOL INSULATOR SYSTEM

BACKGROUND OF THE INVENTION

Electrical distribution systems commonly incorporate insulator devices (insulator) for managing electrical power safely and effectively. An insulator is a material that does not respond to an electric field and completely resists the flow of electric charge. Because no perfect insulator exists, dielectric materials (insulating materials having valence electrons tightly bonded to their atoms—thereby not allowing electrical current to freely flow) are used as insulators. One such type of insulator is the spool insulator, commonly used in conjunction with a terminating end of a power line. If a spool insulator requires replacement, however, usually one or more electrical lines must be removed in order to access the faulty spool insulator. The present invention features a two-piece spool insulator system for convenient installation of a spool insulator around a rack rod without requiring removal of the rack rod from a secondary rack of an electrical distribution system.

SUMMARY

The present invention features a two-piece spool insulator system for convenient installation of a spool insulator for a power line. In some embodiments, the spool insulator system comprises a spool insulator first side component and a spool insulator second side component. In some embodiments, the spool outer surface comprises circumferential grooves located thereon. In some embodiments, the spool first side surface comprises a first side locking pin and a first side locking hole located thereon. In some embodiments, the spool second side surface comprises a second side locking pin and a second side locking hole located thereon. In some embodiments, the first side locking pin is one piece of a mated set with a second side locking hole. In some embodiments, the second side locking pin is one piece of a mated set with a first side locking hole. In some embodiments, the spool insulator comprises a channel located through a central cross section. In some embodiments, for use, the spool insulator first side component attaches to the spool insulator second side component to form a spool insulator system for convenient installation of a spool insulator for a power line.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
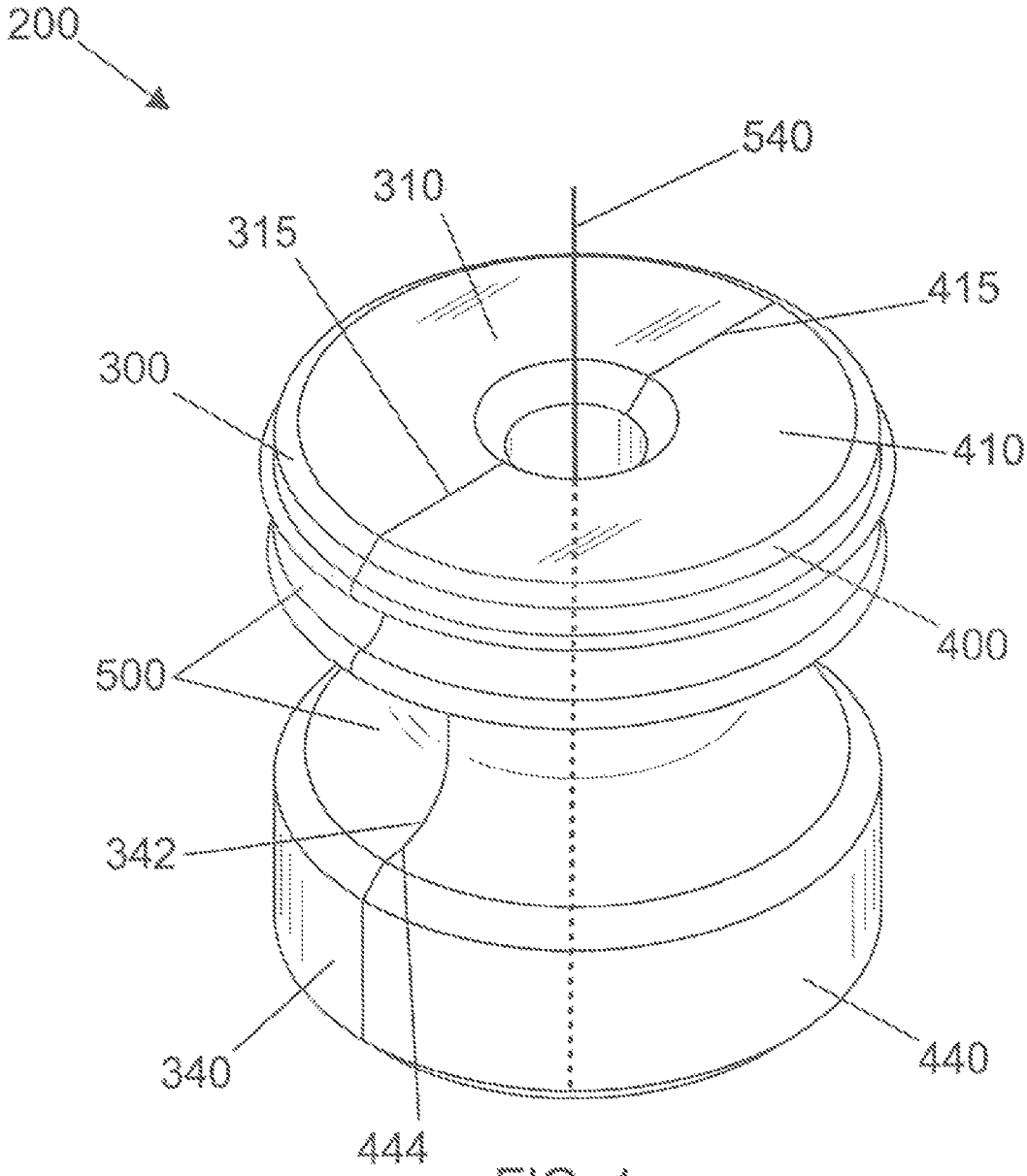
FIG. 1 is a perspective view of the spool insulator of the present invention.
Figure 2:
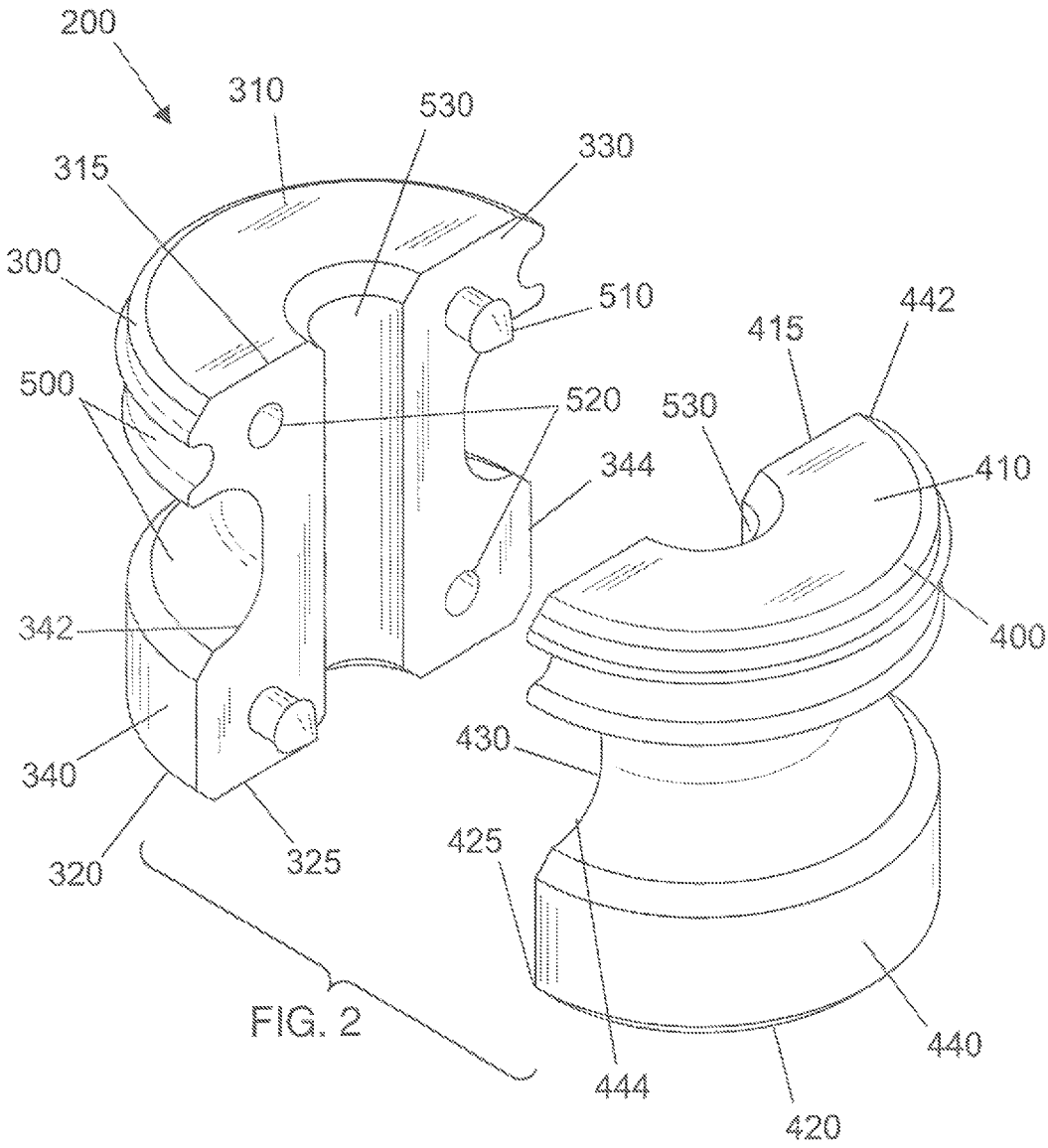
FIG. 2 is a perspective view of the components of the spool insulator of the present invention.
Figure 3:
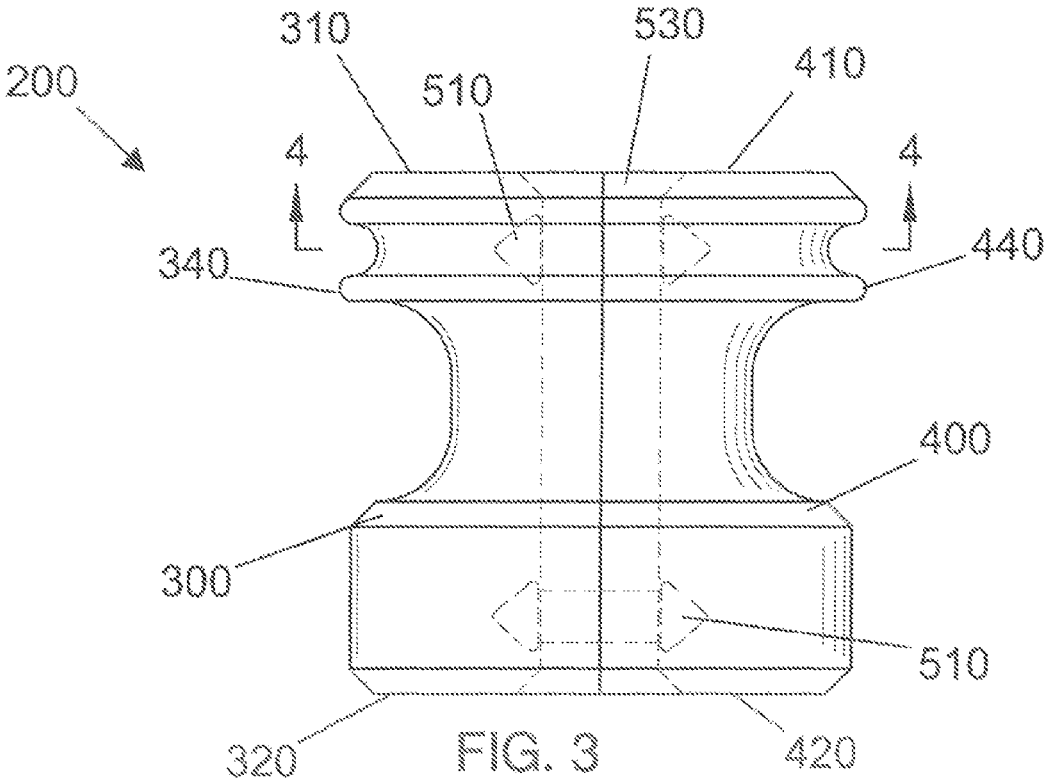
FIG. 3 is a side view of the spool insulator of the present invention.
Figure 4:
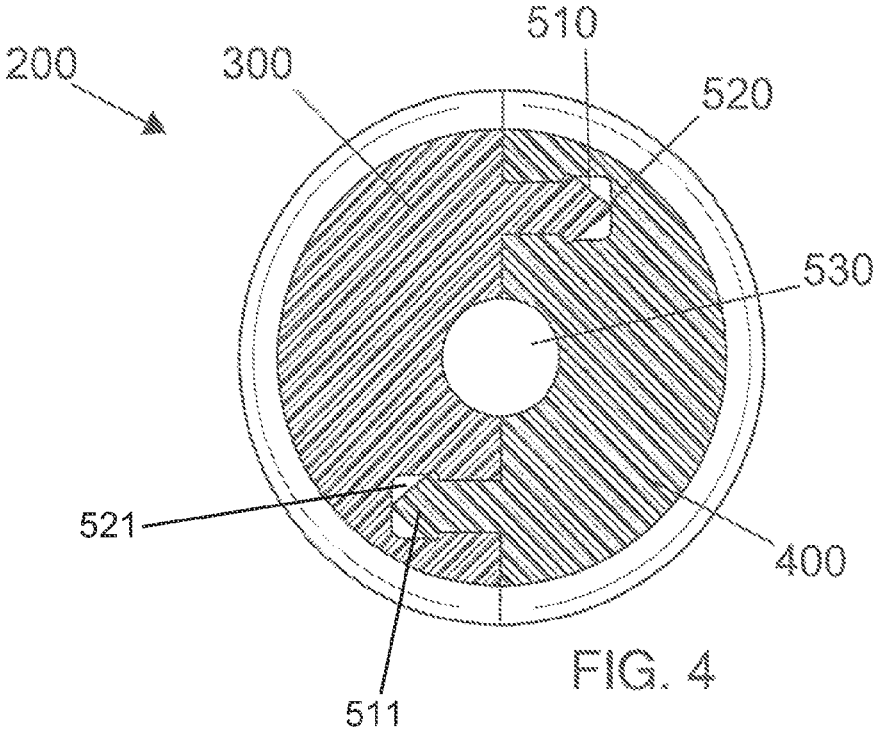
FIG. 4 is a cross-sectional view in a transverse plane of the spool insulator of the present invention.
Figure 5:
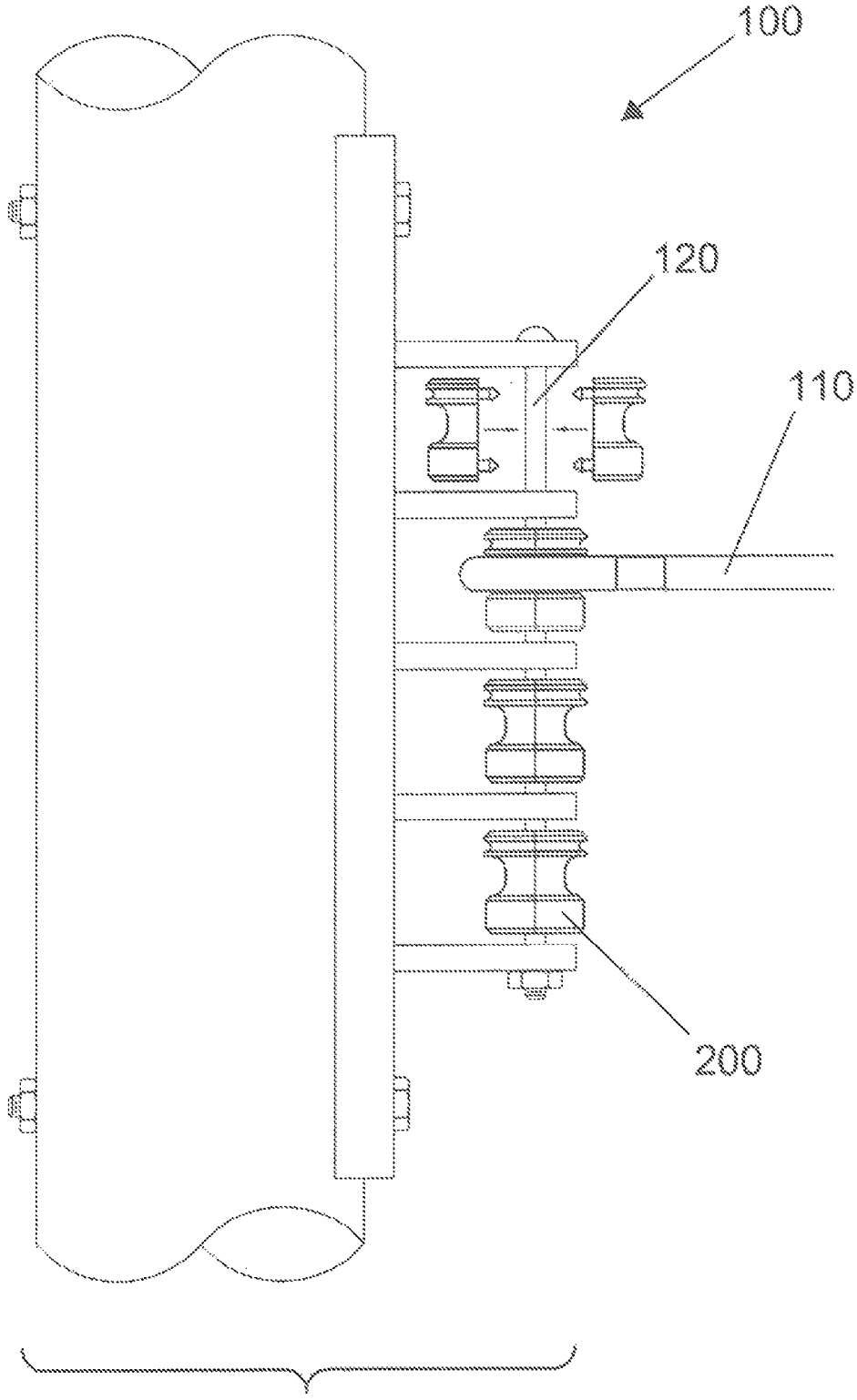
FIG. 5 is a side view of the present invention.

Following is a list of elements corresponding to a particular element referred to herein:

100 Spool insulator system
110 Power line
120 Rack rod
200 Spool insulator
300 Spool insulator first side component
310 Spool first side top surface
315 Spool first side top surface edge
320 Spool first side bottom surface
325 Spool first side bottom surface edge
330 Spool first side surface
340 Spool first side outer surface
342 Spool first side outer surface first edge
344 Spool first side outer surface second edge
400 Spool insulator second side component
410 Spool second side top surface
415 Spool second side top surface edge
420 Spool second side bottom surface
425 Spool second side bottom surface edge
430 Spool second side surface
440 Spool second side outer surface
442 Spool second side outer surface first edge
444 Spool second side outer surface second edge
500 Groove
510 Locking pin
520 Locking hole
530 Channel
540 Central axis Referring now to FIG. 1-5, the present invention features a two-piece spool insulator system (100) for convenient installation of a spool insulator (200) for a power line. In some embodiments, the spool insulator system (100) comprises a spool insulator (200) having a spool insulator first side component (300) and a spool insulator second side component (400). In some embodiments, the spool insulator first side component (300) is one part of a mated two-piece set with a spool insulator second side component (400). In some embodiments, the spool insulator first side component (300) attaches to the spool insulator second side component (400) to form a spool insulator (200). In some embodiments, a spool insulator first side component (300) comprises about a general size of a spool insulator second side component (400).

In some embodiments, the spool insulator first side component (300) comprises a generally planar spool first side top surface (310), a generally planar spool first side bottom surface (320), a generally planar spool first side surface (330) and a generally convex spool first side outer surface (340). In some embodiments, the spool first side outer surface (340) has a profile generally resembling a spool. In some embodiments, the spool first side outer surface (340) comprises circumferential grooves (500) disposed thereon.

In some embodiments, the spool insulator second side component (400) comprises a generally planar spool second side top surface (410), a generally planar spool second side bottom surface (420), a generally planar spool second side surface (430) and a generally convex spool second side outer surface (440). In some embodiments, the spool second side outer surface (440) has a profile generally resembling a spool. In some embodiments, the spool second side outer surface (440) comprises circumferential grooves (500) disposed thereon.

In some embodiments, the spool insulator comprises construction conforming to American National Standards Institute (ANSI) standards. In some embodiments, the spool insulator comprises construction conforming to ANSI C29.3 Class 53 standards.

In some embodiments, the spool first side surface (330) comprises a top first side locking pin (510) located proximal to a corner defined by an intersection of the spool first side top surface edge (315) and a spool first side outer surface second edge (344). In some embodiments, the spool first side surface (330) comprises a top first side locking hole (520) located proximal to a corner defined by an intersection of the spool first side top surface edge (315) and a spool first side outer surface first edge (342). In some embodiments, the spool first side surface (330) comprises a bottom first side locking pin (510) located proximal to a corner defined by an intersection of the spool first side bottom surface edge (325) and the spool first side outer surface first edge (342). In some embodiments, the spool first side surface (330) comprises a bottom first side locking hole (520) located proximal to a corner defined by an intersection of the spool first side bottom surface edge (325) and the spool first side outer surface second edge (344).

In some embodiments, the spool second side surface (430) comprises a top second side locking pin (510) located proximal to a corner defined by an intersection of the spool second side top surface edge (415) and the spool second side outer surface second edge (444). In some embodiments, the spool second side surface (430) comprises a top second side locking hole (520) located proximal to a corner defined by an intersection of the spool second side top surface edge (415) and the spool second side outer surface first edge (442). In some embodiments, the spool second side surface (430) comprises a bottom second side locking pin (510) located proximal to a corner defined by an intersection of the spool second side bottom surface edge (425) and the spool second side outer surface first edge (442). In some embodiments, the spool second side surface (430) comprises a bottom second side locking hole (520) located proximal to a corner defined by an intersection of the spool second side bottom surface edge (425) and the spool second side outer surface second edge (444).

In some embodiments, the locking pin (510) is one piece of a mated set with the locking hole (520). In some embodiments, the locking pin (510) snaps into position upon insertion into the locking hole (520).

In some embodiments, the spool insulator (200) comprises a channel (530) disposed through a central cross-section. In some embodiments, the channel (530) originates at a central axis (540) centrally located at an interface of the spool insulator first side top surface edge (315) and the spool insulator second side top surface edge (415). In some embodiments, the channel (530) terminates at a central axis (540) centrally located at an interface of the spool insulator first side bottom surface edge (325) and the spool insulator second side bottom surface edge (425). In some embodiments, about one half of the channel (530) is disposed in the spool first side surface (330) from the spool first side top surface (310) to the spool first side bottom surface (320). In some embodiments, about one-half of the channel (530) is disposed in the spool second side surface (430) from the spool second side top surface (410) to the spool second side bottom surface (420).

In some embodiments the system (100) comprises a power line (110) disposed on the groove (500) of the spool insulator (200).

In some embodiments, the system (100) comprises a bolt or a rack rod (120) disposed in the channel (530) of the spool insulator (200).

In some embodiments, for use, the spool insulator first side component (300) attaches to the spool insulator second side component (400) to form a spool insulator (200) for convenient installation with a power line (110). In some embodiments, a lineman will be able to install or replace the spool insulator (200) around a rack rod (120) without removing the rack rod (120) from a secondary rack.

In some embodiments, the spool insulator (200) is constructed at least partially from high-density polyvinyl chloride (PVC). In some embodiments, the spool insulator (200) is constructed at least partially from ceramic. In some embodiments, the spool insulator (200) is constructed at least partially from a plastic.

As used herein, the term "about" refers to plus or minus 10% of the referenced number. For example, an embodiment wherein the spool insulator is about 10 inches in length includes a spool insulator that is between 9 and 11 inches in length.

The disclosures of the following U.S. Patents are incorporated in their entirety by reference herein: U.S. Pat. No. D 545,271; U.S. Pat. No. D 375,079; U.S. Pat. No. 7,432,449; U.S. Pat. No. 6,291,774; U.S. Pat. No. 5,413,443; U.S. Pat. No. 4,259,545; U.S. Pat. No. 1,177,867; U.S. Pat. No. 0,787,442.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A two-piece spool insulator system (100) for convenient installation of a spool insulator (200) for a power line, wherein said spool insulator system (100) comprises:

(a) a spool insulator (200) having a spool insulator first side component (300) and a spool insulator second side component (400), wherein the spool insulator first side component (300) is one part of a mated two-piece set with the spool insulator second side component (400), wherein the spool insulator first side component (300) attaches to the spool insulator second side component (400) to form the spool insulator (200), wherein the spool insulator first side component (300) comprises about a general size of the spool insulator second side component (400), wherein the spool insulator first side component (300) comprises a generally planar spool first side top surface (310), a generally planar spool first side bottom surface (320), a generally planar spool first side surface (330) and a generally convex spool first side outer surface (340), wherein the spool first side outer surface (340) has a profile generally resembling a spool, wherein the spool first side outer surface (340) comprises circumferential grooves (500) disposed thereon, wherein the spool insulator second side component (400) comprises a generally planar spool second side top surface (410), a generally planar spool second side bottom surface (420), a generally planar spool second side surface (430) and a generally convex spool second side outer surface (440), wherein the spool second side outer surface (440) has a profile generally resembling a spool, wherein the spool second side outer surface (440) comprises circumferential grooves (500) disposed thereon, wherein the spool first side surface (330) comprises a top first side locking pin (510) located proximal to a corner defined by an intersection of the spool first side top surface edge (315) and a spool first side outer surface second edge (344), wherein the spool first side surface (330) comprises a top first side locking hole (520) located proximal to a corner defined by an intersection of the spool first side top surface edge (315) and a spool first side outer surface first edge (342), wherein the spool first side surface (330) comprises a bottom first side locking pin (510) located proximal to a corner defined by an intersection of the spool first side bottom surface edge (325) and the spool first side outer surface first edge (342), wherein the spool first side surface (330) comprises a bottom first side locking hole (520) located proximal to a corner defined by an intersection of the spool first side bottom surface edge (325) and the spool first side outer surface second edge (344), wherein the spool second side surface (430) comprises a top second side locking pin (510) located proximal to a corner defined by an intersection of the spool second side top surface edge (415) and the spool second side outer surface second edge (444), wherein the spool second side surface (430) comprises a top second side locking hole (520) located proximal to a corner defined by an intersection of the spool second side top surface edge (415) and the spool second side outer surface first edge (442), wherein the spool second side surface (430) comprises a bottom second side locking pin (510) located proximal to a corner defined by an intersection of the spool second side bottom surface edge (425) and the spool second side outer surface first edge (442), wherein the spool second side surface (430) comprises a bottom second side locking hole (520) located proximal to a corner defined by an intersection of the spool second side bottom surface edge (425) and the spool second side outer surface second edge (444), wherein the locking pin (510) is one piece of a mated set with the locking hole (520), wherein the locking pin (510) snaps into position upon insertion into the locking hole (520), wherein when the locking pin (510) is inserted into the locking hole (520) for mating the spool insulator first side component (300) with the spool insulator second side component (400) to form the spool insulator (200), the locking pin (510) is completely enclosed inside the spool insulator (200) such that the locking pin is concealed from view, wherein the locking pin (510) has a barbed tip (511) at it its end, wherein the locking hole (520) has an enlarged cavity (521) at a bottom of the locking hole (520) for the barbed end (511) of the locking pin (510) to insert therein and to be held tightly, wherein the spool insulator (200) comprises a channel (530) disposed through a central cross section thereof, wherein the channel (530) originates at a central axis (540) centrally located at an interface of the spool insulator first side top surface edge (315) and the spool insulator second side top surface edge (415), wherein the channel (530) terminates at a central axis (540) centrally located at an interface of the spool insulator first side bottom surface edge (325) and the spool insulator second side bottom surface edge (425), wherein about one half of the channel (530) is disposed in the spool first side surface (330) from the spool first side top surface (310) to the spool first side bottom surface (320), wherein about one half of the channel (530) is disposed in the spool second side surface (430) from the spool second side top surface (410) to the spool second side bottom surface (420);

(b) a power line (110) disposed in the groove (500) of the spool insulator (200); and (c) a bolt or a rack rod (120) disposed in the channel (530) of the spool insulator (200);

wherein for use, the spool insulator first side component (300) attaches to the spool insulator second side component (400) to form the spool insulator (200) for convenient installation with a power line (110), wherein a lineman will be able to install or replace the spool insulator (200) around a rack rod (120) without removing the rack rod (120) from a secondary rack.

2. The system of claim 1, wherein the spool insulator is constructed at least partially from high-density polyvinyl chloride.

3. A two-piece spool insulator system (100) for convenient installation of a spool insulator (200) for a power line, wherein said spool insulator system (100) consists of:

(a) a spool insulator (200) consisting of a spool insulator first side component (300) and a spool insulator second side component (400), wherein the spool insulator first side component (300) is one part of a mated two-piece set with the spool insulator second side component (400), wherein the spool insulator first side component (300) attaches to the spool insulator second side component (400) to form the spool insulator (200), wherein the spool insulator first side component (300) consists of about a general size of the spool insulator second side component (400), wherein the spool insulator first side component (300) consists of a generally planar spool first side top surface (310), a generally planar spool first side bottom surface (320), a generally planar spool first side surface (330) and a generally convex spool first side outer surface (340), wherein the spool first side outer surface (340) consists of a profile generally resembling a spool, wherein the spool first side outer surface (340) consists of circumferential grooves (500) disposed thereon, wherein the spool insulator second side component (400) consists of a generally planar spool second side top surface (410), a generally planar spool second side bottom surface (420), a generally planar spool second side surface (430) and a generally convex spool second side outer surface (440), wherein the spool second side outer surface (440) consists of a profile generally resembling a spool, wherein the spool second side outer surface (440) consists of circumferential grooves (500) disposed thereon, wherein the spool first side surface (330) consists of a top first side locking pin (510) located proximal to a corner defined by an intersection of the spool first side top surface edge (315) and a spool first side outer surface second edge (344), wherein the spool first side surface (330) consists of a top first side locking hole (520) located proximal to a corner defined by an intersection of the spool first side top surface edge (315) and a spool first side outer surface first edge (342), wherein the spool first side surface (330) consists of a bottom first side locking pin (510) located proximal to a corner defined by an intersection of the spool first side bottom surface edge (325) and the spool first side outer surface first edge (342), wherein the spool first side surface (330) consists of a bottom first side locking hole (520) located proximal to a corner defined by an intersection of the spool first side bottom surface edge (325) and the spool first side outer surface second edge (344), wherein the spool second side surface (430) consists of a top second side locking pin (510) located proximal to a corner defined by an intersection of the spool second side top surface edge (415) and the spool second side outer surface second edge (444), wherein the spool second side surface (430) consists of a top second side locking hole (520) located proximal to a corner defined by an intersection of the spool second side top surface edge (415) and the spool second side outer surface first edge (442), wherein the spool second side surface (430) consists of a bottom second side locking pin (510) located proximal to a corner defined by an intersection of the spool second side bottom surface edge (425) and the spool second side outer surface first edge (442), wherein the spool second side surface (430) consists of a bottom second side locking hole (520) located proximal to a corner defined by an intersection of the spool second side bottom surface edge (425) and the spool second side outer surface second edge (444), wherein the locking pin (510) is one piece of a mated set with the locking hole (520), wherein the locking pin (510) snaps into position upon insertion into the locking hole (520), wherein when the locking pin (510) is inserted into the locking hole (520) for mating the spool insulator first side component (300) with the spool insulator second side component (400) to form the spool insulator (200), the locking pin (510) is completely enclosed inside the spool insulator (200) such that the locking pin is concealed from view, wherein the locking pin (510) has a barbed tip (511) at it its end, wherein the locking hole (520) has an enlarged cavity (521) at a bottom of the locking hole (520) for the barbed end (511) of the locking pin (510) to insert therein and to be held tightly, wherein the spool insulator (200) consists of a channel (530) disposed through a central cross section thereof, wherein the channel (530) originates at a central axis (540) centrally located at an interface of the spool insulator first side top surface edge (315) and the spool insulator second side top surface edge (415), wherein the channel (530) terminates at a central axis (540) centrally located at an interface of the spool insulator first side bottom surface edge (325) and the spool insulator second side bottom surface edge (425), wherein about one half of the channel (530) is disposed in the spool first side surface (330) from the spool first side top surface (310) to the spool first side bottom surface (320), wherein about one half of the channel (530) is disposed in the spool second side surface (430) from the spool second side top surface (410) to the spool second side bottom surface (420);

(b) a power line (110) disposed in the groove (500) of the spool insulator (200); and (c) a bolt or a rack rod (120) disposed in the channel (530) of the spool insulator (200);

wherein for use, the spool insulator first side component (300) attaches to the spool insulator second side component (400) to form the spool insulator (200) for convenient installation with a power line (110), wherein a lineman will be able to install or replace the spool insulator (200) around a rack rod (120) without removing the rack rod (120) from a secondary rack.

* * * * *